US010271620B1

(12) United States Patent
Dickson

(10) Patent No.: US 10,271,620 B1
(45) Date of Patent: Apr. 30, 2019

(54) IMAGE-DISPLAYING PENDANT AND METHOD

(71) Applicant: Norman Garett Dickson, Stony Plain (CA)

(72) Inventor: Norman Garett Dickson, Stony Plain (CA)

( * ) Notice: Subject to any disclaimer, the term of this patent is extended or adjusted under 35 U.S.C. 154(b) by 0 days.

(21) Appl. No.: 15/943,697

(22) Filed: Apr. 2, 2018

(51) Int. Cl.

| | |
|---|---|
| ***H05B 33/08*** | (2006.01) |
| ***F21S 9/02*** | (2006.01) |
| ***A44C 15/00*** | (2006.01) |
| ***G09F 9/30*** | (2006.01) |
| ***A44C 25/00*** | (2006.01) |

(52) U.S. Cl.
CPC ..... *A44C 15/0015* (2013.01); *A44C 15/005* (2013.01); *A44C 25/001* (2013.01); *G09F 9/30* (2013.01)

(58) Field of Classification Search
CPC .... A44C 15/005; A44C 17/02; F21V 33/0008
See application file for complete search history.

(56) References Cited

U.S. PATENT DOCUMENTS 8,234,804 B1 8/2012 Rush
2002/0166338 A1* 11/2002 Cohen ..... A44C 17/02 63/26
2004/0237585 A1* 12/2004 Golden ..... A44C 17/02 63/26
2015/0009654 A1* 1/2015 Chan ..... H05B 33/086 362/104
2018/0270931 A1* 9/2018 Kelly ..... A44C 15/00
2018/0307050 A1* 10/2018 Dholakiya ..... G02B 1/14

FOREIGN PATENT DOCUMENTS

JP 2006247135 A * 9/2006

* cited by examiner

*Primary Examiner* — Nimeshkumar Patel
*Assistant Examiner* — Jacob R Stern
(74) *Attorney, Agent, or Firm* — Integrity Patent Group, PLC; Charles E. Runyan

(57) ABSTRACT

An image-displaying pendant includes a primary jewel, a secondary jewel, a plurality of tertiary jewels, a pendant-cage, a light-emitting diode, and a power source. The primary-jewel may be shaped geometrically as a pyramid having a base-facet, a plurality of lateral-facets adjacent to the base-facet, and an image integrated into n the base-facet which may be viewable through the plurality of lateral-facets. The pendant-cage may support and enclose the primary-jewel. The secondary-jewel may be coupled to the suspension member of the pendant-cage, and the plurality of tertiary-jewels may be affixed to the cage-base of the pendant-cage. The light-emitting diode may impart illumination to the image within the primary-jewel so that is prominently displayed within each facet of the primary-jewel.

18 Claims, 5 Drawing Sheets

IMAGE-DISPLAYING PENDANT AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of jewelry of existing art and more specifically relates to a pendant.

RELATED ART

Jewelry describes any ornamental apparel, particularly smaller apparel used for personal adornment. A wide variety of jewelry types may be used for various applications, such as brooches, earrings, and bracelets. A pendant is a particular type of jewelry describing a loose-hanging ornament, often hung from a necklace or other suspension means. Pendants are one of the oldest forms of jewelry known, and may have particular memorial, functional, or simply ornamental purposes.

Often it is desired to personalize a piece of jewelry for a memorable person, event, or occasion. Jewelry may be customized with various types of ornamental designs for the utility of preserving these memories. However, jewelry is often too simple or unremarkable to sufficiently display and memorialize such memories. A suitable solution is desired.

U.S. Pat. No. 8,234,804 to Janet Rush relates to a laser etched article with illuminable housing. The described laser etched article with illuminable housing includes an etched display incorporating lighting within a housing. A translucent material has a laser-etching of an image that is placed within the stand with at least one edge of the translucent article facing a lighting source whereby the light rays create a translucent article having a higher luminance than the ambient surroundings.

SUMMARY OF THE INVENTION

In view of the foregoing disadvantages inherent in the known pendant art, the present disclosure provides a novel image-displaying pendant and method. The general purpose of the present disclosure, which will be described subsequently in greater detail, is to provide an image-displaying pendant means.

An image-displaying jewelry disclosed herein. In a preferred embodiment the image-displaying jewelry may include an image-displaying pendant. The image-displaying pendant includes a primary jewel, a secondary jewel, a plurality of tertiary jewels, a pendant-cage, a light-emitting diode, and a power source. The primary-jewel may be shaped geometrically as a pyramid having a base-facet, a plurality of lateral-facets adjacent to the base-facet, and an image integrated into the base-facet which may be viewable through the plurality of lateral-facets. The pendant-cage may support and enclose the primary-jewel, and may itself have a cage-base which is disposed beneath and supports the primary-jewel, a suspension member disposed above the primary-jewel, and a plurality of spokes securely connecting the suspension member to the cage-base. The secondary-jewel may be attached to the suspension member of the pendant-cage, and the plurality of tertiary-jewels may be affixed to the cage-base of the pendant-cage. Each of the primary jewel, the secondary jewel, and the plurality of tertiary jewels may be either natural or manufactured jewels. The light-emitting diode may be disposed within the cage-base adjacent to the primary-jewel, such that the light-emitting diode is able to impart illumination to the image of the primary-jewel. The power source may electrically couple to the light-emitting diode in order to provide voltage to the light-emitting diode to illuminate the image.

According to another embodiment, a method of displaying an image within a pendant is also disclosed herein whereby utility functionality is enabled such that the present invention is an 'illuminator' and a 'displayer'. The method of displaying an image within a pendant includes firstly, providing the described image-displaying pendant; secondly, illuminating the light-emitting diode such that the image of the primary-jewel is also illuminated, enabling the image of the primary-jewel to be clearly viewed through the plurality of lateral-facets; thirdly, coloring the primary-jewel; and fourthly, repeatedly coloring the primary-jewel with alternate colors.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an image-displaying pendant and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a pendant and more particularly to an image-displaying pendant and method as used to improve the displaying of an image within a pendant.

Generally, a pendant is provided which prominently displays an image within a jewel. Preferably, the image is laser-engraved into a pyramidal or octahedral jewel, which may be made of diamond, zirconium, glass, or other materials. The image may be a portrait or other type of image commemorating a person, event, or any other memory. The jewel is illuminated from beneath in order to draw attention to the image, which may be viewed from all sides of the jewel. The arrangement of angled facets around the jewel may cause a hologram-like effect, adding dimension to the image. Auxiliary jewels may be arranged around the jewel containing the image and may also be illuminated. The pendant includes a base and cage which enclose and support the image and jewels. An additional feature may include a control mechanism which causes the lighted jewels to cycle between colors. Preferably, these colors may include the seven chakra colors: red, orange, yellow, green, blue, indigo, and violet. Alternatively, the lighted jewels may be made to flash. Preferably, the pendant cage includes eight spokes connecting the base of the pendant to a suspension mechanism which fastens the pendant to a necklace. These various features draw attention and lend prominence to the image displayed within the pendant.

Referring now more specifically to the drawings by numerals of reference, there is shown in FIGS. 1-4, various views of a pendant 100.

Figure 1:
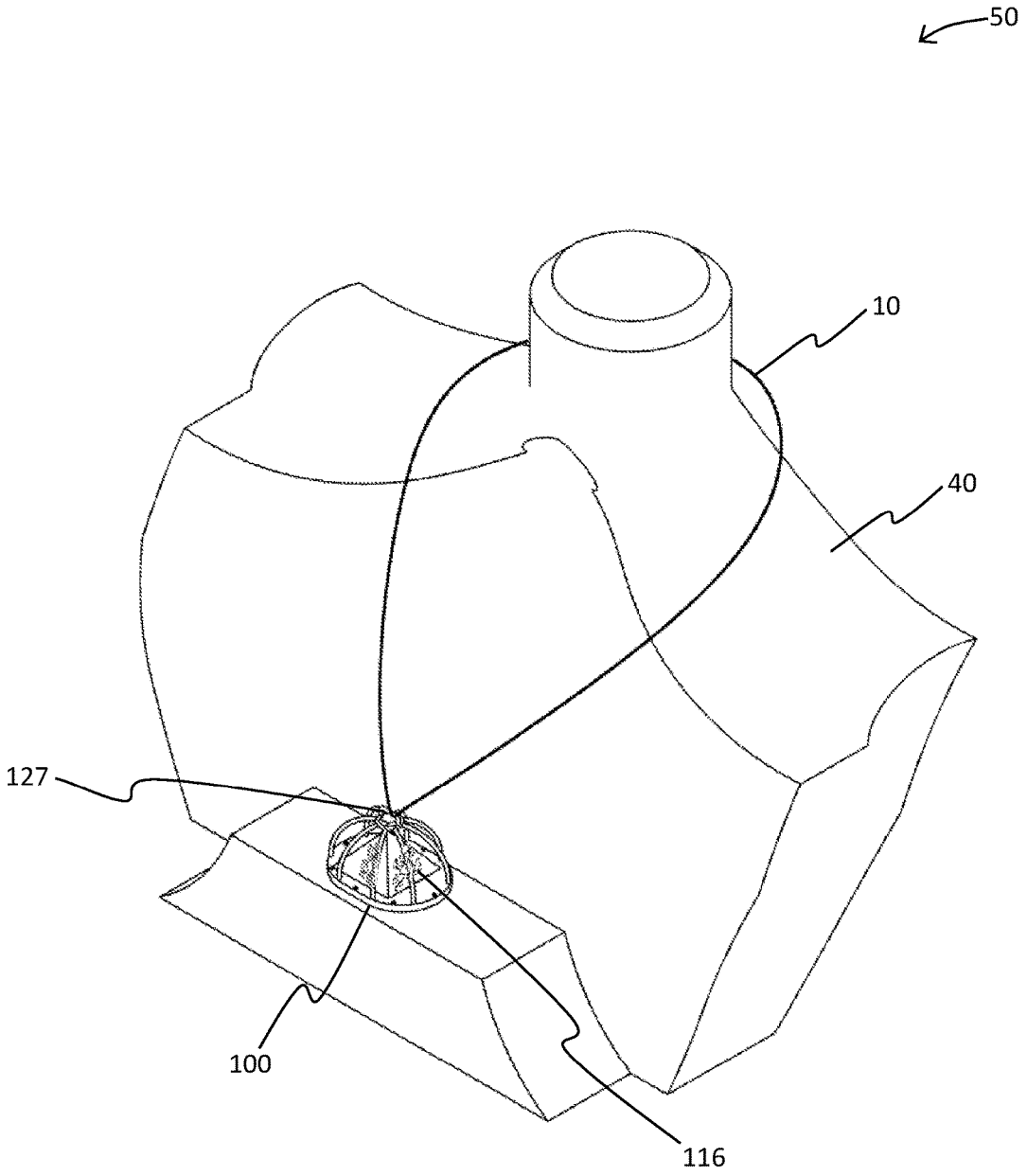
FIG. 1 is a perspective view of the image-displaying pendant as worn by a user during an 'in-use' condition, according to an embodiment of the disclosure.

FIG. 1 shows a pendant 100 during an 'in-use' condition 50, according to an embodiment of the present disclosure. Here, the pendant may be beneficial for use by a user 40 to display an image within a pendant 100. As illustrated, the pendant 100 may include image 116 and ring 127. Pendant 100 is configured to display image 116. Pendant 100 may include ring 127 configured to fasten pendant 100 to necklace 10, necklace 10 being configured to retain pendant 100 to user 40. Image 116 may be prominently displayed while pendant 100 is worn by user 40. Upon reading this specification, it should be appreciated that, under appropriate circumstances, considering such issues as user preferences, design preference, structural requirements, marketing preferences, cost, available materials, technological advances, etc., other structural and electrical arrangements such as, for example, additional control system features, alternative pendant cage designs, ornamental additions, images, messages, logos, etc., may be sufficient.

Figure 2:
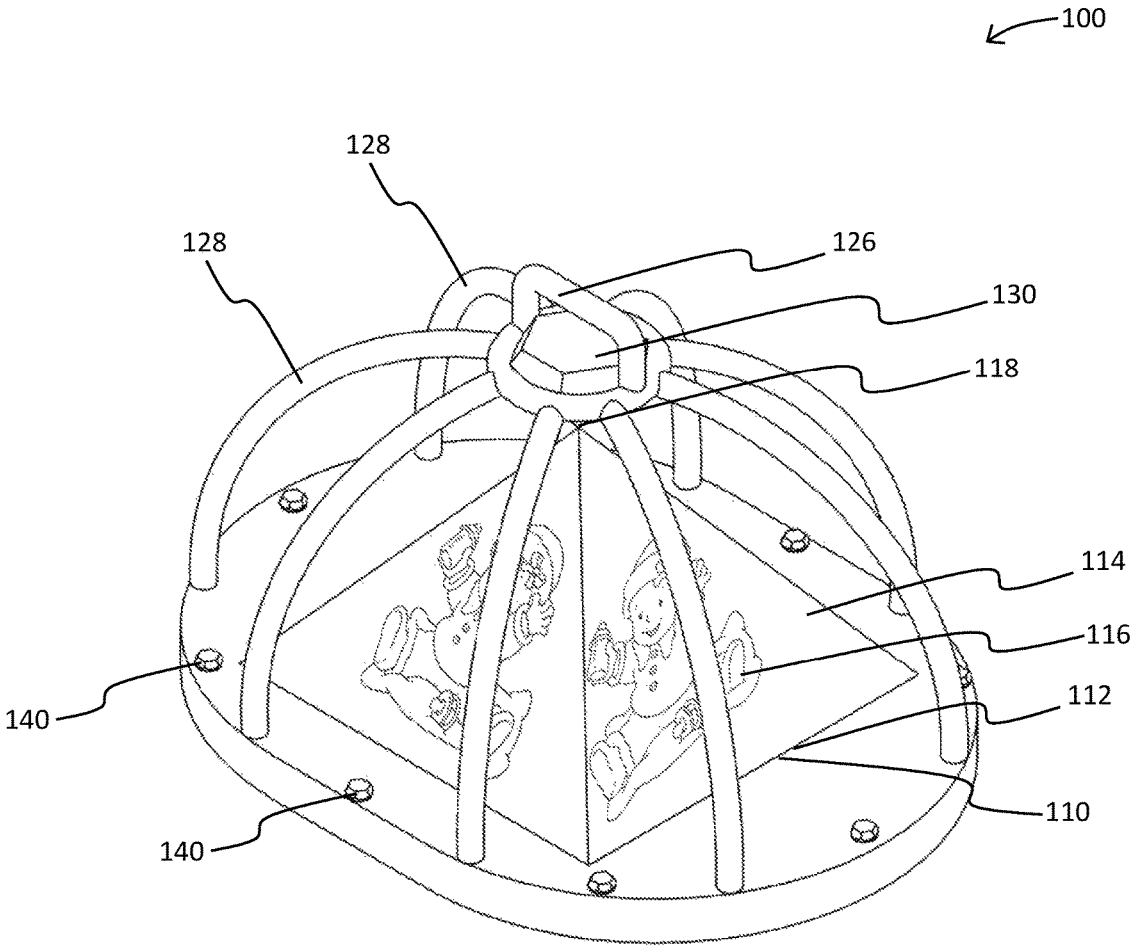
FIG. 2 is a perspective view of the image-displaying pendant of FIG. 1, according to an embodiment of the present disclosure.

Referring now to FIG. 2 showing the pendant 100 of FIG. 1, according to an embodiment of the present disclosure. Pendant 100 for displaying image 116 may include primary-jewel 110, primary-jewel 110 being shaped as a geometric pyramid. Primary-jewel 110 may include base-facet 112, plurality of lateral-facets 114 disposed adjacent to base-facet 112, and image 116 disposed on base-facet 112. Image 116 may be viewable through plurality of lateral-facets 114, such that image 116 may be viewed from any side of pendant 100 except from beneath. Pendant may further include pendant-cage 120, pendant-cage 120 being structured and arranged to support and enclose primary-jewel 110. Pendant cage 120 may include cage-base 122 disposed beneath and supporting primary-jewel 110, suspension member 126 disposed above primary-jewel 110, and plurality of spokes 128 coupling suspension member 126 to cage-base 122. Cage-base 122 may include outer edge 124. Suspension member 126 may be coupled to ring 127 (FIG. 1). Pendant 100 may further include secondary jewel 130 coupled to suspension member 126 of pendant-cage 120, and plurality of tertiary-jewels 140 affixed to cage-base 122 of pendant-cage 120. Base-facet 112 of primary-jewel 110 is substantially square, and plurality of lateral-facets 114 comprise four substantially triangular facets terminating in apex 118, apex 118 being disposed distal to base-facet 112. Preferably, image 116 of primary-jewel 110 is laser-engraved into base-facet 112 of primary-jewel 110.

Figure 3:
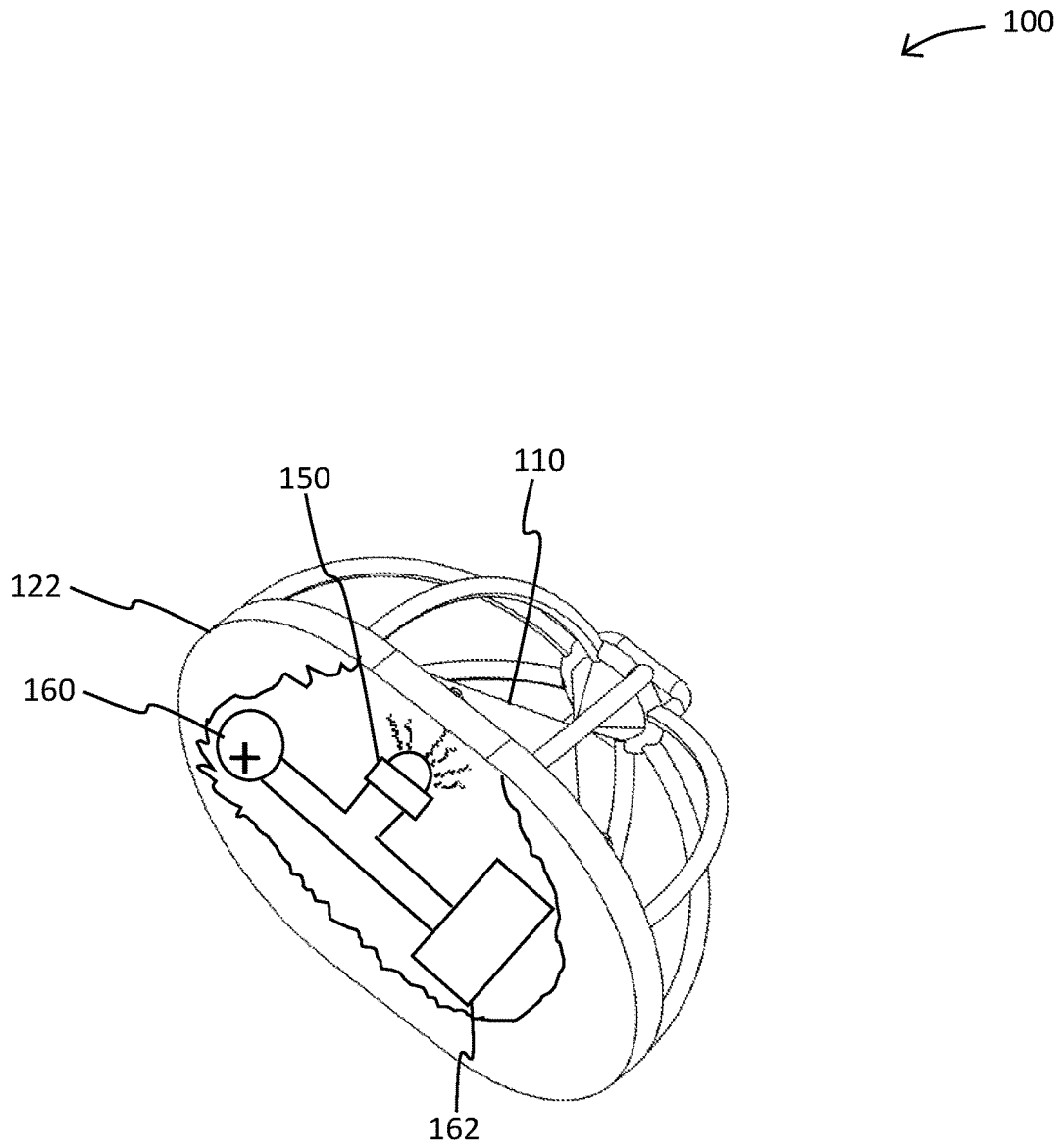
FIG. 3 is a cut-away perspective view of the light-emitting diode and power source of the image-displaying pendant of FIG. 1, according to an embodiment of the present disclosure.

FIG. 3 is a perspective view of the image-displaying pendant 100 of FIG. 1, according to an embodiment of the present disclosure. Pendant 100 may further include light-emitting diode 150, power source 160, and control mechanism 162. Light-emitting diode 150 may be disposed within cage-base 122 adjacent to primary-jewel 110 and may be structured and arranged to impart illumination to image 116 of primary-jewel 110. Power source 160 may be electrically coupled to light-emitting diode 150, such that power source 160 is able to illuminate light-emitting diode 150. Control mechanism 162 may electrically connect power source 160 to light-emitting diode 150 and may enable light-emitting diode 150 to be flashed between a lit condition and an unlit condition. Control mechanism 162 may further enable light-emitting diode 150 to be cycled through various colors.

Figure 4:
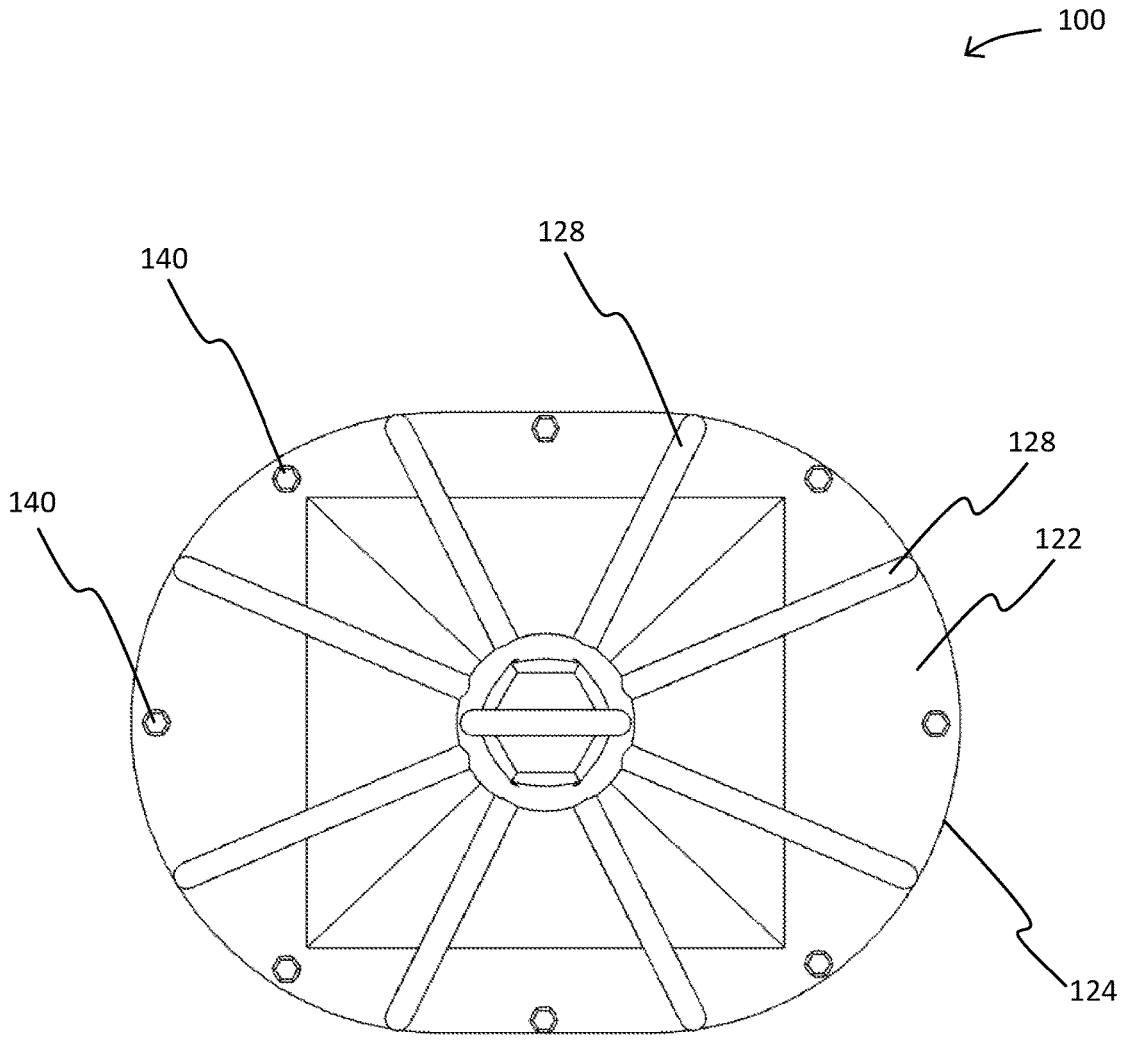
FIG. 4 is a top perspective view of the image-displaying pendant of FIG. 1, according to an embodiment of the present disclosure.

FIG. 4 is a perspective view of the image-displaying pendant 100 of FIG. 1, according to an embodiment of the present disclosure. Plurality of tertiary-jewels 140 may comprise eight tertiary-jewels radially arranged about outer edge 124 of cage-base 122 of pendant-cage 120. Likewise, plurality of spokes 128 may comprise eight spokes radially arranged.

Figure 5:
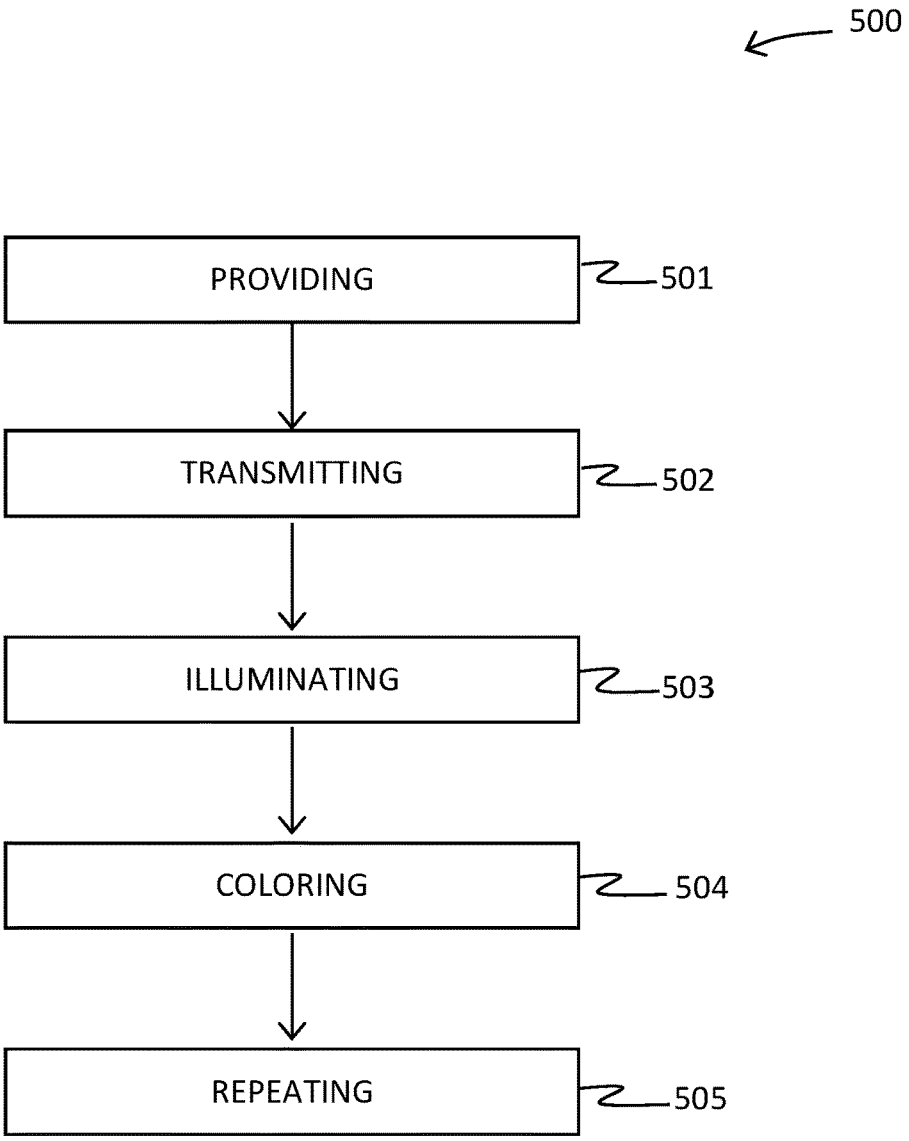
FIG. 5 is a flow diagram illustrating a method of use for prominently displaying an image within a pendant, according to an embodiment of the present disclosure.

Referring now to FIG. 5, a flow diagram illustrating a method for displaying 500 an image within a pendant 100, according to an embodiment of the present disclosure. In particular, the method for displaying 500 an image within a pendant 100 may include one or more components or features of the pendant 100 as described above. As illustrated, the method for displaying 500 an image within a pendant 100 may include the steps of: step one 501, providing a pendant comprising a primary-jewel shaped as a geometric pyramid having a base-facet, a plurality of lateral-facets adjacent to the base-facet, and an image disposed on the base facet, a pendant-cage supporting and surrounding the primary-jewel having a cage-base disposed beneath and supporting the primary-jewel having an outer edge, a suspension member disposed above the primary-jewel, and a plurality of spokes coupling the suspension member to the cage-base, a secondary-jewel coupled to the suspension member of the pendant-cage, a plurality of tertiary-jewels affixed to the cage-base of the pendant-cage, a light-emitting diode disposed adjacent to the primary-jewel, the light-emitting diode being configured to impart illumination to the image of the primary-jewel, and a power source configured to illuminate the light-emitting diode; step two 502, transmitting power from the power source to the light-emitting diode; step three 503, illuminating the light-emitting diode such that the image of the primary-jewel is also illuminated, enabling the image of the primary-jewel to be clearly viewed through the plurality of lateral-facets; step four 504, coloring the primary-jewel a first color, and violet; and step five 505, repeating the coloring of the primary-jewel with subsequent colors.

It should be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for displaying an image within a pendant, are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A pendant for displaying an image comprising:

a substantially translucent primary-jewel shaped as a geometric pyramid having a base-facet, a plurality of lateral-facets adjacent to the base-facet, and an image disposed on the base-facet viewable through the plurality of lateral-facets;

a pendant-cage supporting and surrounding the primary-jewel having a cage-base disposed beneath and supporting the primary-jewel having an outer edge, a suspension member disposed above the primary-jewel, and a plurality of spokes coupling the suspension member to the cage-base;

a secondary-jewel coupled to the suspension member of the pendant-cage;

a plurality of tertiary-jewels affixed to the cage-base of the pendant-cage;

a light-emitting diode disposed within the cage-base adjacent to the primary-jewel, the light-emitting diode being configured to impart illumination to the image of the primary-jewel; and a power source electrically coupled to the light-emitting diode configured to illuminate the light-emitting diode to provide an illuminator and displayer means.

2. The pendant of claim 1, wherein the primary-jewel, the secondary-jewel, and the tertiary-jewels are diamonds.

3. The pendant of claim 1, wherein the primary-jewel, the secondary-jewel, and the tertiary-jewels are glass.

4. The pendant of claim 1, wherein the primary-jewel, the secondary-jewel, and the tertiary-jewels are zirconium.

5. The pendant of claim 1, wherein the base-facet of the primary-jewel is a square, and the plurality of lateral-facets comprise four triangular facets terminating in an apex distal to the base-facet.

6. The pendant of claim 1, wherein the plurality of tertiary-jewels comprise eight tertiary-jewels radially arranged about the outer edge of the cage-base of the pendant-cage.

7. The pendant of claim 1, wherein the suspension member of the pendant-cage further includes a ring configured to fasten the pendant-cage to a necklace.

8. The pendant of claim 2, wherein the primary-jewel weighs between three and fifteen carats.

9. The pendant of claim 2, wherein the primary-jewel weighs five carats.

10. The pendant of claim 2, wherein the secondary-jewel weighs one carat.

11. The pendant of claim 2, wherein each of the plurality of tertiary-jewels weighs one-quarter of one carat.

12. The pendant of claim 2, wherein each of the plurality of tertiary-jewels weighs one-quarter of the weight of the secondary-jewel.

13. The pendant of claim 1, wherein the image of the primary-jewel is laser-engraved into the base-facet of the primary-jewel.

14. The pendant of claim 1, wherein the plurality of spokes comprises eight spokes radially arranged.

15. The pendant of claim 1, wherein the pendant further includes a control mechanism electrically connecting the power source to the light-emitting diode, the control mechanism enabling the light-emitting diode to be flashed between a lit condition and an unlit condition.

16. The pendant of claim 3, wherein the control mechanism further enables the light-emitting diode to be cycled through seven colors, the seven colors comprising red, orange, yellow, green, blue, indigo, and violet.

17. The image-displaying pendant comprising:

a substantially translucent primary-jewel shaped as a geometric pyramid having a base-facet, a plurality of lateral-facets adjacent to the base-facet, and an image disposed on the base-facet viewable through the plurality of lateral-facets;

a pendant-cage supporting and surrounding the primary-jewel having a cage-base disposed beneath and supporting the primary-jewel having an outer edge, a suspension member disposed above the primary-jewel, and a plurality of spokes coupling the suspension member to the cage-base;

a secondary-jewel coupled to the suspension member of the pendant-cage;

a plurality of tertiary-jewels affixed to the cage-base of the pendant-cage;

a light-emitting diode disposed within the cage-base adjacent to the primary-jewel, the light-emitting diode being configured to impart illumination to the image of the primary-jewel; and a power source electrically coupled to the light-emitting diode configured to illuminate the light-emitting diode;

wherein the base-facet of the primary-jewel is a square, and the plurality of lateral-facets comprise four triangular facets terminating in an apex distal to the base-facet;

wherein the plurality of tertiary-jewels comprise eight tertiary-jewels radially arranged about the outer edge of the cage-base of the pendant-cage;

wherein the suspension member of the pendant-cage further includes a ring configured to fasten the pendant-cage to a necklace;

wherein the primary-jewel weighs five carats;

wherein the secondary-jewel weighs one carat;

wherein each of the plurality of tertiary-jewels weighs one-quarter of one carat;

wherein the image of the primary-jewel is laser-engraved into the base-facet of the primary-jewel;

wherein the plurality of spokes comprises eight spokes radially arranged;

wherein the pendant further includes a control mechanism electrically connecting the power source to the light-emitting diode, the control mechanism enabling the light-emitting diode to be flashed between a lit condition and an unlit condition;

wherein the control mechanism further enables the light-emitting diode to be cycled through seven colors, the seven colors comprising red, orange, yellow, green, blue, indigo, and violet; and wherein the image-displaying pendant provides an illuminator and displayer means.

18. A method of use for displaying an image in a piece of jewelry, the method comprising providing a pendant comprising a primary-jewel shaped as a geometric pyramid having a base-facet, a plurality of lateral-facets adjacent to the base-facet, and an image disposed on the base facet, a pendant-cage supporting and surrounding the primary-jewel having a cage-base disposed beneath and supporting the primary-jewel having an outer edge, a suspension member disposed above the primary-jewel, and a plurality of spokes coupling the suspension member to the cage-base, a secondary-jewel coupled to the suspension member of the pendant-cage, a plurality of tertiary-jewels affixed to the cage-base of the pendant-cage, a light-emitting diode disposed adjacent to the primary-jewel, the light-emitting diode being configured to impart illumination to the image of the primary-jewel, and a power source configured to illuminate the light-emitting diode;

transmitting power from the power source to the light-emitting diode;

illuminating the light-emitting diode such that the image of the primary-jewel is also illuminated, enabling the image of the primary-jewel to be clearly viewed through the plurality of lateral-facets;

coloring the primary-jewel a first color selected from the group comprising red, orange, yellow, green, blue, indigo, and violet; and repeating the coloring of the primary-jewel with subsequent colors selected from the group comprising red, orange, yellow, green, blue, indigo, and violet.

* * * * *